US009409691B2

(12) United States Patent
Utz

(10) Patent No.: US 9,409,691 B2
(45) Date of Patent: Aug. 9, 2016

(54) METHOD FOR THE PRODUCTION OF SELF-VENTING PACKAGING

(75) Inventor: Helmar Utz, Koppingen (CH)

(73) Assignee: Amcor Flexibles Transpac N.V., Zaventem (BE)

( * ) Notice: Subject to any disclaimer, the term of this patent is extended or adjusted under 35 U.S.C. 154(b) by 1109 days.

(21) Appl. No.: 13/059,349

(22) PCT Filed: Jun. 24, 2009

(86) PCT No.: PCT/EP2009/057912

§ 371 (c)(1),
(2), (4) Date: Apr. 18, 2011

(87) PCT Pub. No.: WO2010/020453

PCT Pub. Date: Feb. 25, 2010

(65) Prior Publication Data

US 2011/0179754 A1 Jul. 28, 2011

(30) Foreign Application Priority Data

Aug. 19, 2008 (EP) ..... 08447040

(51) Int. Cl.
*B65B 25/00* (2006.01)
*B65D 77/22* (2006.01)
*B65D 81/34* (2006.01)

(52) U.S. Cl.
CPC ..... *B65D 77/225* (2013.01); *B65D 81/3461* (2013.01); *B65D 2205/00* (2013.01); *B65D 2205/02* (2013.01)

(58) Field of Classification Search
CPC .. B65D 77/22; B65D 77/225; B65D 2205/00; B65D 2205/02; B65D 81/34; B65D 81/3446; B65D 81/3453; B65D 81/3461; B65D 81/3469; B65D 33/01; A23L 1/0128; A23L 1/01
USPC ..... 426/410, 412, 394, 395, 397, 407, 401, 426/520, 521, 107, 109, 113, 114, 118, 426/234; 53/440, 467, 469, 471; 383/100, 383/103
See application file for complete search history.

(56) References Cited

U.S. PATENT DOCUMENTS 7,314,645 B2 * 1/2008 Lee et al. ..... 426/106
2005/0202743 A1 * 9/2005 Hausmann et al. ..... 442/334

(Continued)

FOREIGN PATENT DOCUMENTS

DE 201 20 253 U1 4/2002
EP 0 537 108 A2 4/1993

(Continued)

OTHER PUBLICATIONS

Heinz et al. ("Canning/Sterilization of Meat Products"), Meat Processing Technology for Small- to Medium-Scale Producers, FAO, pub. 2007, pp. 277-285. ftp://ftp.fao.org/docrep/fao/010/ai407e/ai407e10.pdf.*

(Continued)

*Primary Examiner* — Jyoti Chawla
(74) *Attorney, Agent, or Firm* — Reinhart Boerner Van Deuren P.C.

(57) ABSTRACT

The present invention relates to a method for the production of a self-venting packaging for use in heating a food item in a microwave oven, said packaging comprising a rupturable valve seal (3), said rupturable valve seal comprising an inside-inside seal, creating a weak point on said packaging, suitable to break in case of overpressure inside the packaging, said method comprising the following subsequent steps: providing an open plastic packaging; filling said packaging with a food item; —sealing the plastic packaging to obtain a closed pack via a closing seal with the food item therein ready to be sterilised; heat treating said food item; providing a rupturable valve seal (3) on the pack by ultrasound seal technology.

15 Claims, 8 Drawing Sheets

(56) References Cited

U.S. PATENT DOCUMENTS

| | | | | |
|---|---|---|---|---|
| 2005/0255200 | A1* | 11/2005 | Takahagi et al. | 426/113 |
| 2005/0276885 | A1 | 12/2005 | Bennett | |
| 2006/0127549 | A1 | 6/2006 | Murray | |
| 2007/0071855 | A1* | 3/2007 | Kanzaki | 426/107 |
| 2008/0044525 | A1 | 2/2008 | Fenn-Barrabass et al. | |

FOREIGN PATENT DOCUMENTS

| | | | |
|---|---|---|---|
| EP | 0 537 109 | A2 | 4/1993 |
| EP | 1 067 058 | A1 | 1/2001 |
| GB | 2 188 520 | A | 9/1987 |
| GB | 2 414 226 | A | 11/2005 |
| JP | 2005187079 | A | 7/2005 |
| JP | 2006095708 | A | 4/2006 |
| WO | WO 2004/048225 | A1 | 6/2004 |

OTHER PUBLICATIONS

Barbosa et al "Food Sterilization by combining high pressure and Thermal Energy" pp. 9-13 and citation from Food Engineering by Gutierrez-Lopez 2008 Springer.com.*

* cited by examiner

METHOD FOR THE PRODUCTION OF SELF-VENTING PACKAGING

FIELD OF THE INVENTION

The present invention relates to self-venting packaging, in particular to a method wherein a self-venting valve with a weakening stress point is provided after the filling process on ordinary packaging without a specific limitation in valve location.

The present invention is more precisely related to a method for the production of a self-venting plastic packaging for heating a food item in a microwave oven.

STATE OF THE ART

One of the current market trends in packaging is convenience, which is driven by the growing number of single household consumers who, for various reasons, do not want to cook any more, and the demand on ready meals that just have to be reheated is therefore constantly growing. Such ready meals are often packed in trays with a lid or in pouches.

Microwave heating is the preferred way to reheat the meals. To avoid bursting when the hermetically packed product is heated, conventional trays or pouches have to be at least partially opened or for example perforated to allow the steam to escape when the meal becomes hot and the contained water transforms to vapour.

Several valve systems integrated in the packaging (in the laminate, add-ons or additional seals) have been developed, which allows to heat for instance vegetables or ready-meals just by putting them in the microwave oven. These systems have advantages like a steam cooking effect, less humidity loss or an indication that the product is hot by the opening noise of the valve. But those systems require a particular packaging structure or packaging process.

WO 2004/048225 describes a valve system that is integrated in the laminate and opens in a non-destructive way via steam pressure building up in the pack during heating. This specific structure is obviously more expensive than an ordinary packaging.

US 2005/0276885 discloses a microwavable food item packed in a self-venting packaging where a rupturable seal is placed at various locations along the aperture. This document does not explain how the sterilisation problem can be solved without using counter-pressure, which is difficult to manage in an autoclave, in order to avoid the rupture of the rupturable seal during the sterilisation process.

EP 1 067 058 describes a steam valve on a stand-up pouch that is an additional seal with a hole in the middle. The seal is placed to the pouch in such a way that it can still be filled after the valve has been sealed. In this document, the valve is performed before it is filled to avoid seal problems due to inside contamination with content.

GB 2414226A and JP 2005187079 describe a similar valve which is an additional seal. In opposition to EP 1 067 058, the seal strength is lower and opens by peeling between the two sealing layers.

JP 2006095708 shows a 4-side sealed pouch with an additional lap seal which opens by peeling as well.

Although self-venting packs for chilled or frozen food are already well established, only very few ready-meals that are typically sterilised in an autoclave have been introduced in the market. In general, the opening pressure of the valve has to be significantly lower than the burst pressure of the pack under the same conditions, otherwise the pack would break.

To obtain a shelf-stable and safe product (commercial sterile), the temperature in an autoclave is typically higher than 121° C. (Buchner N.: *Verpackung von Lebensmitteln*, Berlin: Springer, 1999). To avoid that the flexible packs expand and even burst during the heat treatment, an appropriate counter-pressure has to be applied. As the water-vapour pressure in an autoclave is changing during the sterilisation cycle (heating-up, sterilisation at constant temperature and cooling), the counter-pressure has to be adjusted to avoid the blowing up and collapsing of the packs as much as possible to prevent any damage (Campden & Chorleywood Food Research Association Group: *Guidelines on good manufacturing practice for heat processed flexible packaging*, Guidelines No. 50, Chipping Campden: 2006).

Beside pressure control, the right filling—not too much air and/or product—as well as an appropriate positioning of the packs in the retort trays is essential as this can create uncontrolled overpressure inside the packs.

Another thermal process to produce shelf-stable products is pasteurization which is a heat treatment below 100° C. without counter pressure (Buchner N.; *Verpackung von Lebensmitteln*, Berlin: Springer, 1999). For some products, e.g. in case of pH<4.5, this treatment is sufficient to achieve a shelf-stable product. During heat treatment, the packed product and the air in the pack expand according to their coefficient of expansion. Depending on the amount of air and product in the pack, this expansion can open a valve applied on the pack. This is especially relevant for rigid or semi-rigid trays with a lid as there is no additional space in the pack which allows a compensation of the expansion. Typically the bottom of such trays can turn outward in case there is a pressure build up in the pack and it moves back when the tray is cooled down. Valves on such trays would not withstand the generated inside pressure.

In the light of the previous explanations, it becomes clear that there is a real need for a packaging method of microwavable food items, capable of self-venting via a rupturable weak point when heated up in a microwave oven, where the rupturable weak point is performed on the packaging after the filling and the heat treatment step of the method.

DEFINITIONS

In the following description, the expression "ultrasonic seal valve" is used to describe a rupturable valve seal comprising an inside-inside seal performed by ultrasound seal technology.

The expression "inside-inside seal" or "inside against inside" is related to the seal of the inner layers of a packaging container, which are those layers in contact or potentially in contact with the food item (see FIGS. 9 and 10). For instance, in the case of a lid sealed on a tray, the inside layer of the lid (potentially in contact with the food item) is sealed against the inside layer of the tray.

In the present invention "inside-inside seal" should be understood as a seal between the inside layer of a first panel (deep drawn tray) and an inside layer of a second panel (lid), said first and second panels being sealed together to form a self-venting packaging with a food item inside. The word "inside" means the side of the panel potentially in contact with the food item. Such an inside-inside (inside against inside) seals performed by ultrasound seal technology reduces the global thickness of the two superposed layer (see FIG. 13) and creates a rupturable weak point which breaks and opens the pack in case of overpressure inside and allows the steam to escape (see FIGS. 14 and 15).

AIMS OF THE INVENTION

The present invention aims to overcome the drawbacks of the prior art and provides a method for the manufacturing of an ultrasonic seal valve on ordinary filled packaging without particular valve positioning and configuration and with minimal constraints for the location of such a valve.

The present invention provides more precisely a self-venting packaging for use in heating a food item in a microwave oven, said packaging comprising a rupturable valve seal (3), said rupturable valve seal comprising an inside-inside seal performed by ultrasound seal technology, called "ultrasonic seal valve".

SUMMARY OF THE INVENTION

The present invention discloses a method for the production of a self-venting packaging for use in heating a food item in a microwave oven, said packaging comprising a rupturable valve seal (3), said rupturable valve seal comprising an inside-inside seal, creating a weak point on said packaging, suitable to break in case of overpressure inside the packaging, said method comprising the following subsequent steps:

- providing an open plastic packaging;
- filling said packaging with a food item;
- sealing the plastic packaging to obtain a closed pack via a closing seal with the food item therein ready to be sterilised;
- heat treating said food item;
- providing a rupturable valve seal (3) on the packaging by ultrasound seal technology.

Particular embodiments of the present invention comprise at least one or an appropriate combination of the following features:

- the heat treatment is a sterilisation above 100° C.;
- the heat treatment is a pasteurization;
- the rupturable valve seal is a triangular, an oval or a round valve seal;
- the rupturable valve seal is a triangular, an oval or a round valve seal with punched hole;
- the rupturable valve seal is a triangular, an oval or a round valve seal with cut;
- the rupturable valve seal is a V-shaped valve seal;
- the rupturable valve seal is a straight line;
- the self-venting packaging is a standing pouch;
- the self-venting packaging is a tray;
- the tray comprises a coextrudate of polypropylene and polyethylene vinyl alcohol copolyper;
- the inside-inside seal is performed on polyethylene or polypropylene seal layer;
- the plastic packaging comprises a laminate, said laminate comprising at least one layer selected from the group consisting of a barrier coated polyester and a polyamide;
- the barrier coating is selected from the group consisting of aluminium oxide, silicon oxide and organic barrier coating.

KEYS

Figure 1:
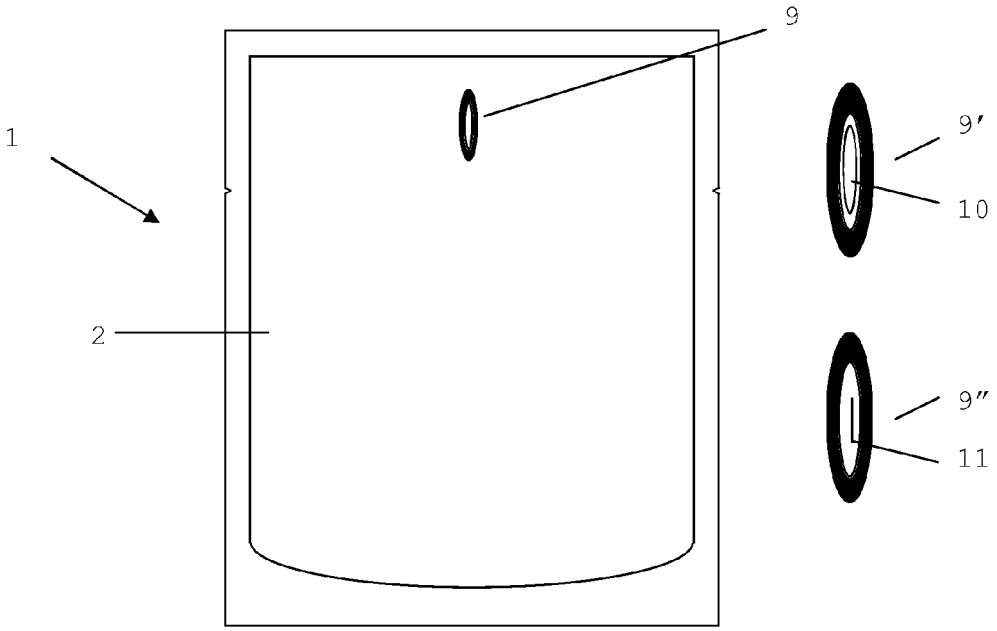
FIG. 1 shows a stand-up pouch with oval ultrasonic valve seal—closed in the middle, with punctured hole and with a simple cut.
Figure 2:
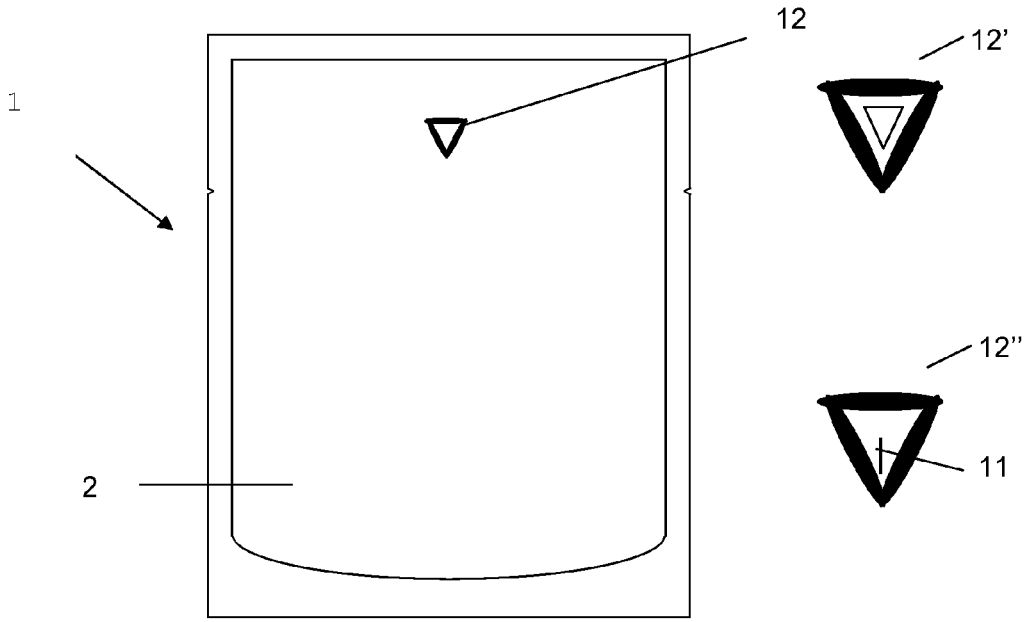
FIG. 2 shows a stand-up pouch with triangular ultrasonic valve seal—closed in the middle, with punctured hole and with a simple cut.

1 self-venting stand-up pouch
2 content compartment
3 ultrasonic valve seal
4 polypropylene sealing layer
5 OPA layer
6 PETP-AlOx
References 9-16 are particular embodiments of the ultrasonic valve seal 3.
9 oval ultrasonic valve seal
9' oval ultrasonic valve seal with punched oval hole
9" oval ultrasonic valve seal with cut
10 punched oval hole
11 cut
12 triangular ultrasonic valve seal
12' triangular ultrasonic valve seal with punched triangular hole
12" triangular ultrasonic valve seal with cut
13 round ultrasonic valve seal
13' round ultrasonic valve seal with punched round hole
13" round ultrasonic valve seal with cut
14 V-shaped ultrasonic valve seal
15 ultrasonic valve seal—straight line
16 V-shaped turned ultrasonic valve seal, placed at the side
17 4-side sealed pouch with ultrasonic valve seal
18 form fill seal pack with fin seal
19 form fill seal pack with lap seal
20 tray
21 standard lid seal

DETAILED DESCRIPTION OF THE INVENTION

The safest way to prevent a damage or opening of a self-venting overpressure valve during heat treatment is to apply the valve after the heat treatment process. As already described, most valves are constructed as additional seals.

Nevertheless, after processing and filling the packaging, the inner sealing layer is heavily contaminated by the content. Additionally, in case of sterilisation and because of the high temperatures and contact with the content, the sealing properties can change. Product ingredients of the content can migrate into the sealing layer. This is the reason why usual sealing methods do not allow the production of a reliable valve seal after filling of the packaging.

A very special sealing method is ultrasonic sealing. An advantage of this technology is that it is possible to perform inside-inside seals of packaging through contaminations.

Several tests have demonstrated that the ultrasonic sealing method allows reproducible valve seals even after the sterilisation process, which was a surprise.

Apart from being able to avoid any interference with the sterilisation process, since the valve seal is performed after the sterilisation process, another advantage is that there is no limitation for the valve position which would be given if the packaging's with valve have to be filled.

Figure 5:
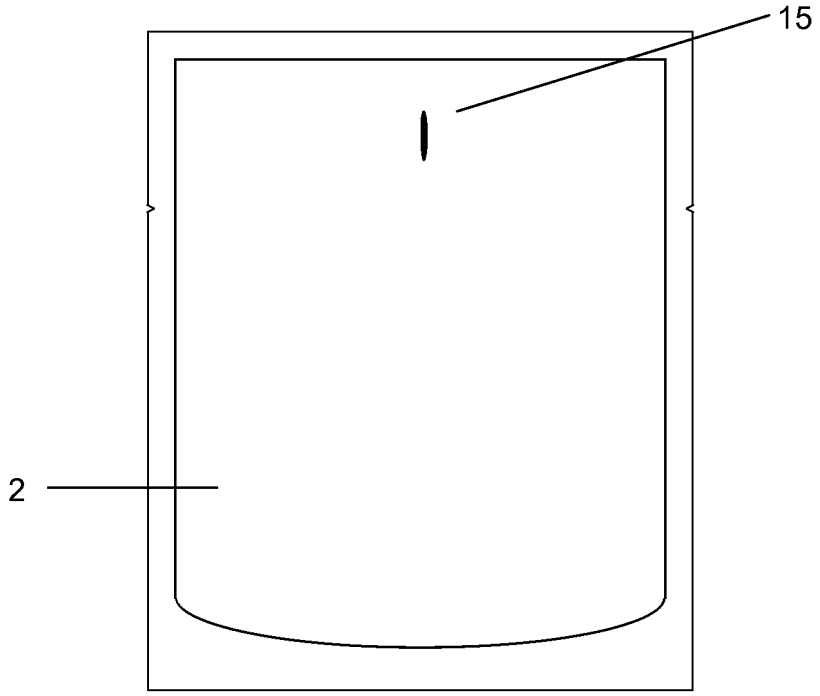
FIG. 5 shows a stand-up pouch with ultrasonic valve seal—straight line.
Figure 6:
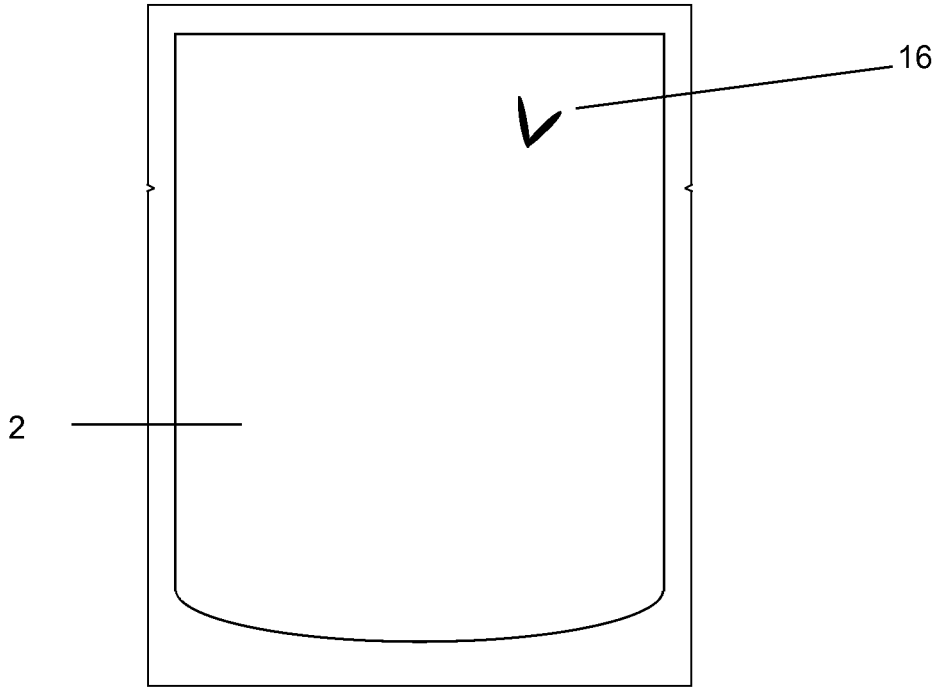
FIG. 6 shows a stand-up pouch with V-shaped turned ultrasonic valve seal, placed at the side of the bag.

FIGS. 1 to 5 shows several layouts of ultrasonic valve seals while FIG. 6 shows one possible different position. In addition to stand-up pouches, FIGS. 7 to 10 shows a valve on 4-side sealed pouches as well as form fill seal versions.

Figure 11:
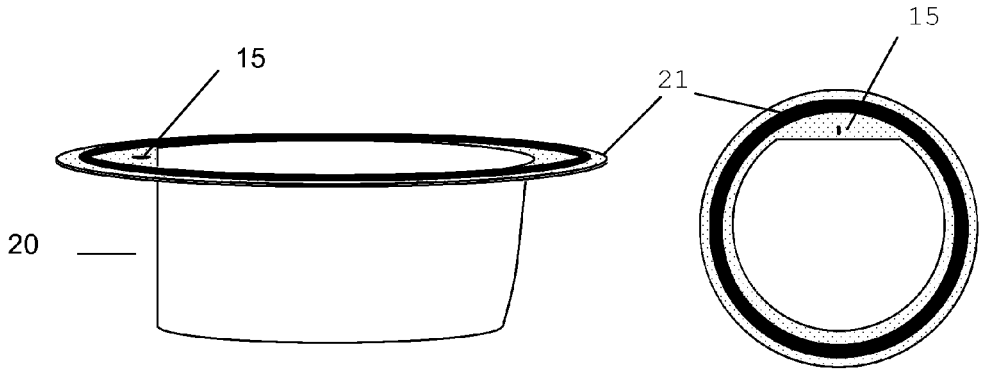
FIG. 11 shows a tray with standard sealed lid on the top and an additional ultrasonic valve seal—side and top view.
Figure 12:
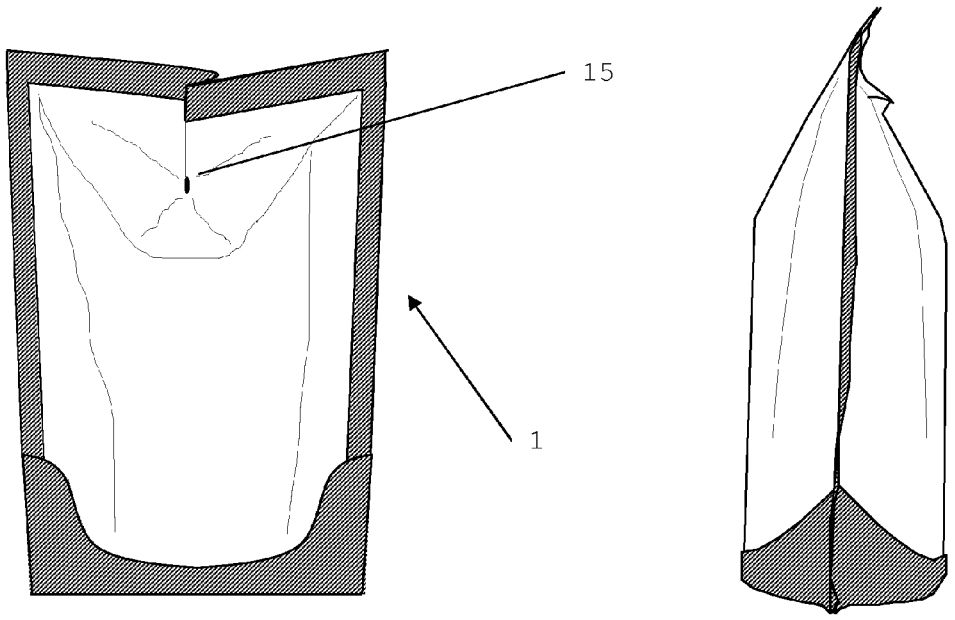
FIG. 12 shows the front and side view of a blown-up pouch with the broken ultrasonic seal valve.

FIG. 11 shows a tray with a lid comprising an ultrasonic valve seal.

EXAMPLES

Example 1

Figure 3:
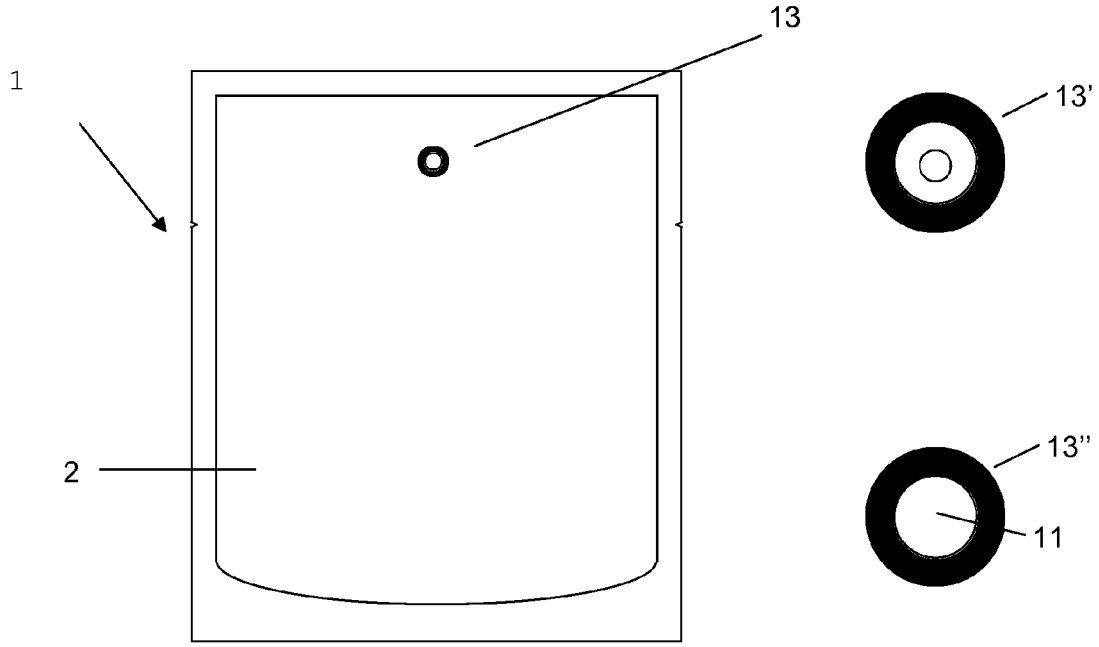
FIG. 3 shows a stand-up pouch with round ultrasonic valve seal—closed in the middle, with punctured hole and with a simple cut.
Figure 4:
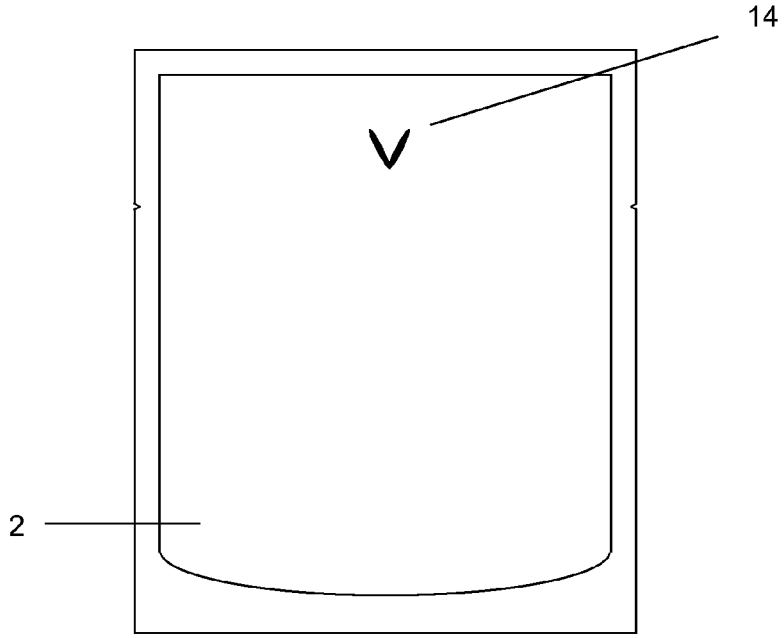
FIG. 4 shows a stand-up pouch with V-shaped ultrasonic valve seal.

By using a PS Dialog 1000 ultrasonic sealing unit (Herrmann Ultraschalltechnik), a valve seal as shown in FIG. 3 (ring seal 13", with cut 11 in the middle) was applied in the upper middle of a processed and filled stand-up pouch (width 140 mm, height 190 mm, round gusset 40 mm) which was filled with rice.

Figure 13:
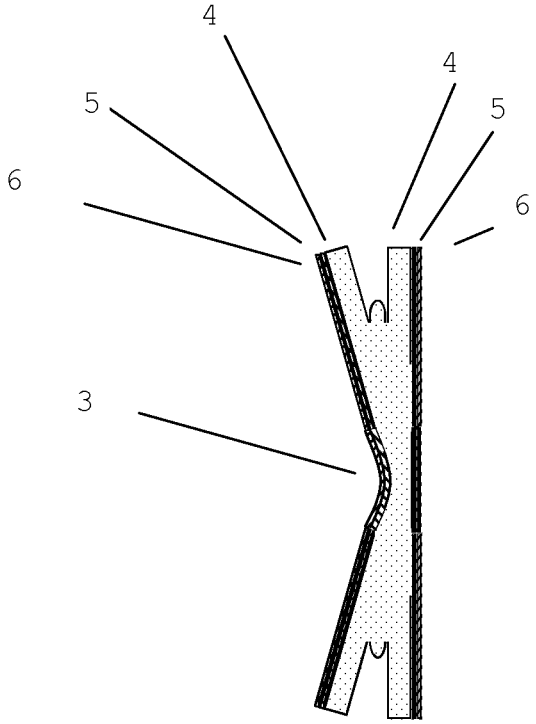
FIG. 13 shows a detailed cross-sectional view with the inside-inside seal in a filled pouch with seal valve.
Figure 14:
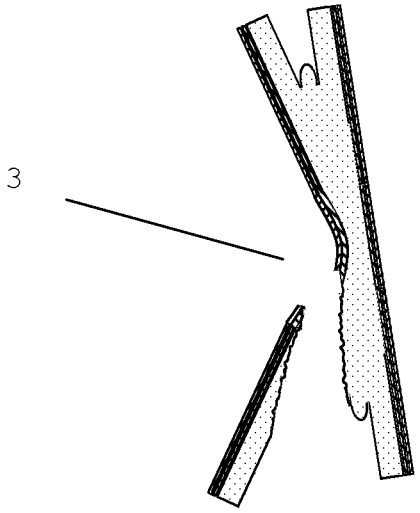
FIG. 14 shows a cross-sectional view of a blown-up pouch front and a side view with the broken ultrasonic valve seal.
Figure 15:
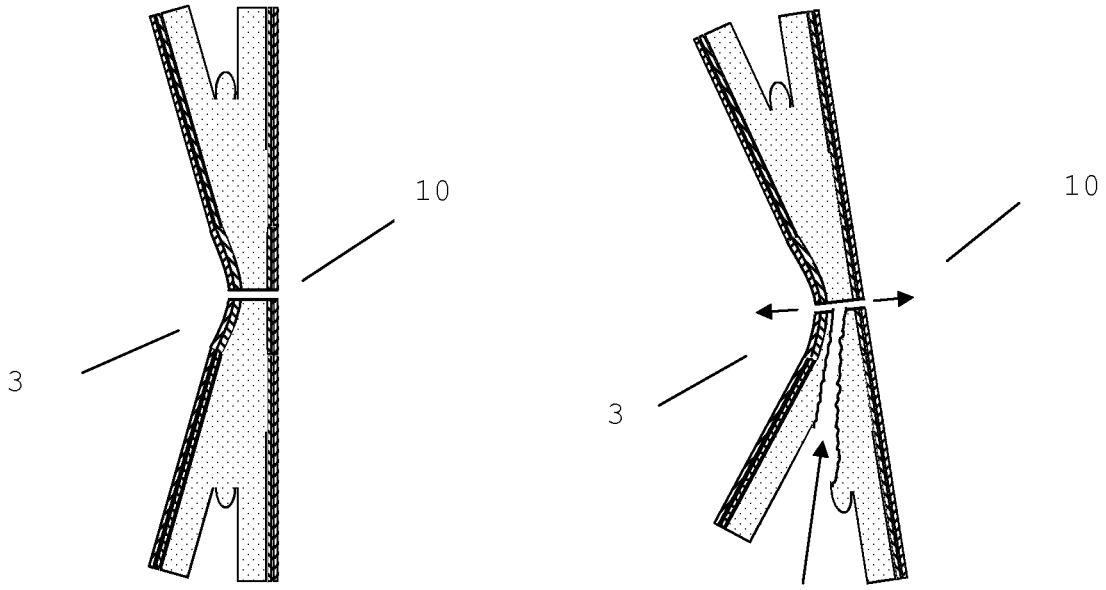
FIG. 15 shows an additional opening mechanism of the ultrasonic valve seal with hole.

The laminate used for this pouch was a PETP-AlOx 12 μm/OPA 15 μm/PP 70 μm produced from aluminium oxide coated 12 μm polyester (Camclear 800) adhesive laminated (Adcote 811 with Cat F) to a 15 μm biaxially oriented polyamide (Biaxis 15) again adhesive laminated (Adcote 811/Cat F) to a 70 μm polypropylene film (Groflex 0969.000) (see layer structure of FIG. 13)

The pouch was heated in a microwave oven at a power of 700 W. After about 1 minute and 30 seconds, the pouch started to expand and the valve opened by fracture of the laminate.

Example 2

A valve seal as shown in FIG. 5 (5 mm long straight line 15) was applied in the upper middle of the processed and filled stand-up pouch according to Example 1 filled with rice.

The pouch was heated in a microwave oven at a power of 700 W. After around 1 minute and 30 seconds the pouch started to expand and the valve opened by fracture of the laminate.

Example 3

Figure 9:
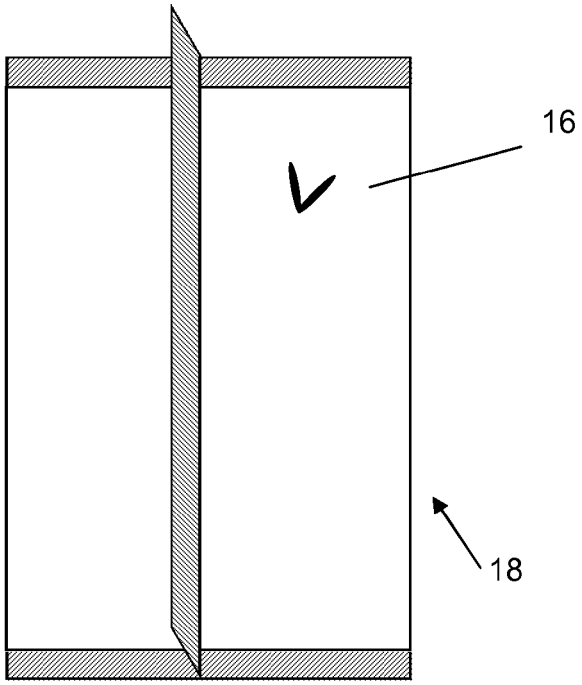
FIG. 9 shows a form fill seal pack with fin seal (inside against inside) and with V-shaped ultrasonic valve seal.
Figure 10:
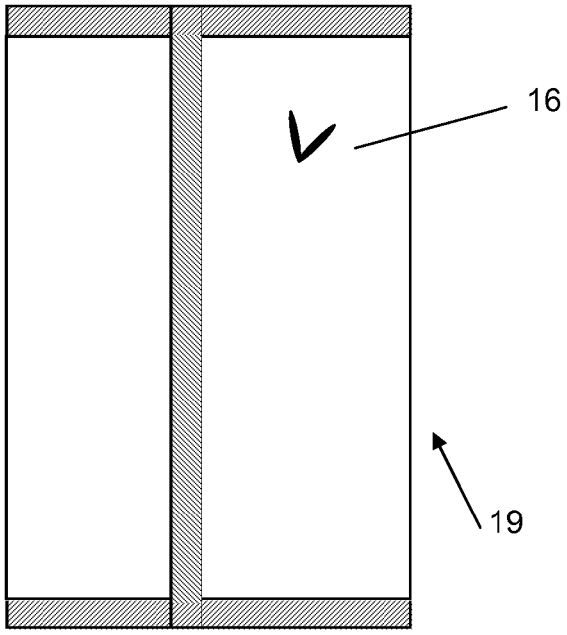
FIG. 10 shows a form fill seal pack with lap seal (inside against outside) and with V-shaped ultrasonic valve seal.

A valve seal as shown in FIGS. 6, 9 and 10 (V-shaped seal 16) was positioned at the upper side of a processed stand-up pouch according to Example 1 filled with rice.

The pouch was heated in a microwave oven at a power of 700 W. After around 1 minute and 30 seconds, the pouch started to expand and the valve opened by fracture of the laminate.

Example 4

Figure 7:
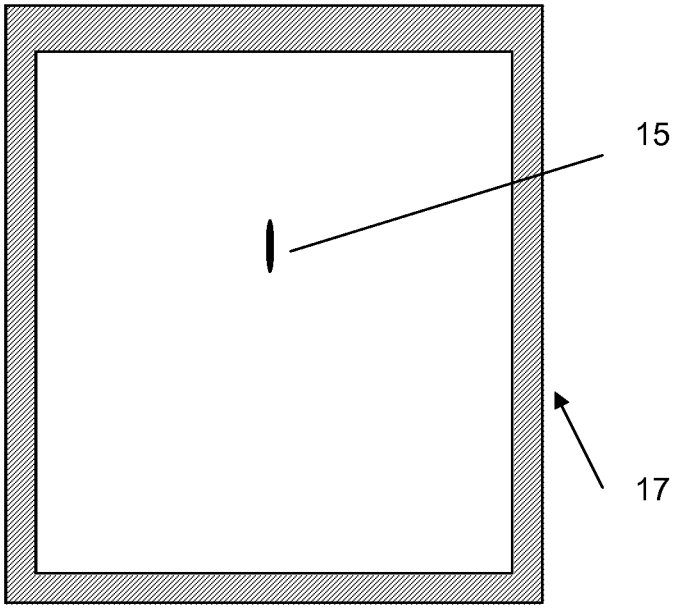
FIG. 7 shows a 4-side sealed pouch with ultrasonic valve seal—straight line.
Figure 8:
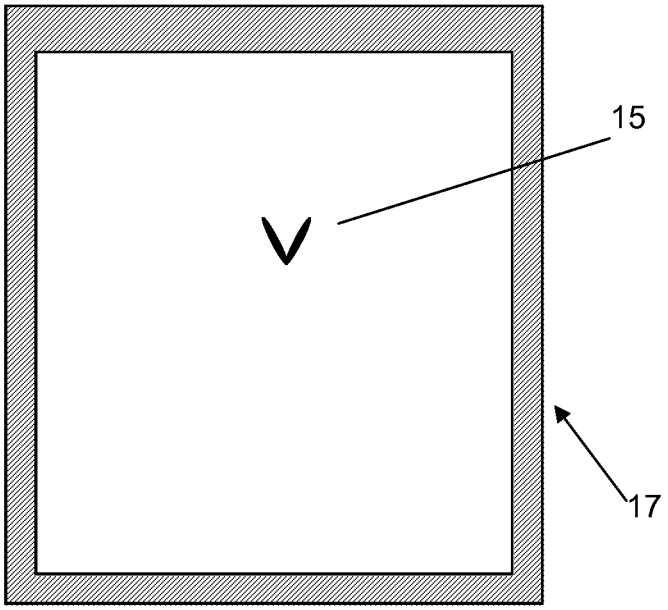
FIG. 8 shows a 4-side sealed pouch with V-shaped ultrasonic valve seal.

A valve seal as shown in FIG. 7 (5 mm long straight line 15) was positioned at the upper middle of a processed 4-side sealed pouch (140×140 mm) filled with a tomato sauce.

The pouch was heated laying flat in a microwave oven at a power of 700 W. After around 1 minute and 15 seconds, the pouch started to expand and the valve opened by fracture of the laminate.

Example 5

A valve seal as shown in FIG. 11 was applied to a heat treated tray with a peelable lid made from a laminate of barrier polyester 12 μm adhesive laminated to a polyamide of 15 μm laminated to a peelable PP of 50 μm. The pack included a pasta product with sauce.

The tray was heated in a microwave oven at a power of 700 W. After around 1 minute, the tray started to expand and the valve opened by rupture of the valve seal.

The present invention shows a method allowing the production of a packaging with a steam valve after filling, and possibly after heat treatment, with limited constraint of the positioning of said valve. The described invention can also be used for semi-rigid or rigid trays and cups with a flexible lidding film by using a simple ultrasonic seal equipment rendering the complexity of add-on valve processing lines or structurally complex packaging useless.

Additional Examples of Possible Multilayer Laminates

- barrier polyester PET (aluminium oxide coated, silicon oxide coated, organic barrier coating)/polyamide PA//polypropylene PP, polyethylene PE
- polyester PET/barrier polyester PET (aluminium oxide coated, silicon oxide coated, organic barrier coating)/polypropylene PP, polyethylene PE
- polyester/barrier polyamide (aluminium oxide coated, silicon oxide coated, organic barrier coating)/polypropylene PP, polyethylene PE
- barrier polyester PET (aluminium oxide coated, silicon oxide coated, organic barrier coating)/polypropylene PP, polyethylene PE
- barrier polyamide PA (aluminium oxide coated, silicon oxide coated, organic barrier coating)/polypropylene PP, polyethylene PE Examples for Tray and Lid Multilayer Tray:

- polypropylene PP,
- polyester PET,
- coextrusion of polypropylene with polyethylene vinyl alcohol copolyper EVOH as barrier.

Lid:

- polyester with sealable coating,
- polypropylene PP
- laminates:
  - barrier polyester PET (aluminium oxide coated, silicon oxide coated, organic barrier coating)/polyamide PA//polypropylene, polyethylene;
  - polyester PET/barrier polyester PET (aluminium oxide coated, silicon oxide coated, organic barrier coating)/polypropylene, polyethylene;

polyester/barrier polyamide (aluminium oxide coated, silicon oxide coated, organic barrier coating)/polypropylene, polyethylene;

barrier polyester PET (aluminium oxide coated, silicon oxide coated, organic barrier coating)/polypropylene, polyethylene;

barrier polyamide PA (aluminium oxide coated, silicon oxide coated, organic barrier coating)/polypropylene, polyethylene.

The present invention is based on European patent application N° 08447040.0, of which priority is claimed and which is incorporated herein by reference.

The invention claimed is:

1. Method for production of a self-venting packaging for use in heating a food item in a microwave oven , said packaging comprising a rupturable valve seal, said rupturable valve seal creating a weak point on said packaging, suitable to break in case of overpressure inside the packaging, said method comprising the following consecutive steps:

providing an open plastic packaging;

filling said packaging with a food item;

sealing the plastic packaging to obtain a closed pack via a closing seal with the food item therein; the closing seal extending along the entire perimeter of the package;

heat treating said food item by pasteurization or sterilization above 100° C;

providing a rupturable valve seal on the packaging, said rupturable valve seal comprising an inside-inside seal obtained by ultrasound technology; said rupturable valve seal being not connected to the closing seal and formable through an area of food contamination.

2. Method according to claim 1, wherein the rupturable valve seal is distant from the closing seal of the packaging.

3. Method according to claim 1, wherein said rupturable valve seal is a triangular, an oval or a round valve seal.

4. Method according to claim 1, wherein said rupturable valve seal is a triangular, an oval or a round valve seal with punched hole.

5. Method according to claim 1, wherein said rupturable valve seal is a triangular, an oval or a round valve seal with a cut.

6. Method according to claim 1, wherein said rupturable valve seal is a V-shaped valve seal.

7. Method according to claim 1, wherein said rupturable valve seal is a straight line.

8. Method according to claim 1, wherein the self-venting packaging is a standing pouch.

9. Method according to claim 1, wherein the inside-inside seal is performed on polyethylene or polypropylene seal layer.

10. Method according to claim 1, wherein said plastic packaging comprises a laminate, said laminate comprising at least one layer selected from the group consisting of a barrier coated polyester and polyamide.

11. Method according to claim 1, wherein said barrier coating is selected from the group consisting of aluminium oxide, silicon oxide and organic barrier coating.

12. Method according to claim 1, wherein the self-venting packaging is a tray.

13. Method according to the claim 12, wherein said tray comprises a coextrudate of polypropylene and polyethylene vinyl alcohol copolymer.

14. Method for production of a self-venting packaging for use in heating a food item in a microwave oven, said method comprising the following consecutive steps:

first providing an open plastic packaging; then filling said packaging with a food item; then sealing the plastic packaging to obtain a closed pack via a closing seal with the food item therein; the closing seal extending along the entire perimeter of the package; then heat treating said food item by pasteurization or sterilization above 100° C; then providing a rupturable valve seal on the packaging, said rupturable valve seal comprising an inside-inside seal obtained by ultrasound technology; said rupturable valve seal being not connected to the closing seal and formable through an area penetrated by the food item; and wherein said rupturable valve seal creates a weak point on said packaging, suitable to break in case of overpressure inside the packaging.

15. Method for production of a self-venting packaging for use in heating a food item in a microwave oven, said method comprising the following consecutive steps:

first providing an open plastic packaging; then filling said packaging with a food item; then sealing the plastic packaging to obtain a closed pack via a closing seal with the food item therein; the closing seal extending along the perimeter of the package; then providing a first heat treatment above 100° C. in order to sterilize said food item; then providing a rupturable valve seal on the packaging, said rupturable valve seal comprising an inside-inside seal obtained by ultrasound technology; said rupturable valve seal being not connected to the closing seal and formable through an area penetrated by the food item; and wherein said packaging comprises a rupturable valve seal, said rupturable valve seal creating a weak point on said packaging, suitable to break in case of overpressure inside the packaging during a second heating step in a microwave oven.

* * * * *